US005146971A

United States Patent [19]

McCarty

[11] Patent Number: 5,146,971

[45] Date of Patent: Sep. 15, 1992

[54] STRIP DOOR SUSPENSION SYSTEM

[75] Inventor: Lon H. McCarty, Estacada, Oreg.

[73] Assignee: Econo Max Manufacturing, Gresham, Oreg.

[21] Appl. No.: 491,354

[22] Filed: Mar. 9, 1990

[51] Int. Cl.[5] ..... E05D 15/00

[52] U.S. Cl. ..... 160/184; 160/332; 160/380

[58] Field of Search ..... 160/184, 332, 380, 196.1, 160/345, 328; 211/94; 411/437

[56] References Cited

U.S. PATENT DOCUMENTS

| | | | |
|---|---|---|---|
| 3,424,225 | 1/1969 | Magnusson | 160/345 |
| 3,564,666 | 2/1971 | Dold | 411/437 X |
| 4,265,480 | 5/1981 | Suzuki et al. | 16/96 R X |
| 4,289,190 | 9/1981 | Catan | 160/184 X |
| 4,340,106 | 7/1982 | Van Horn, II | 160/184 X |
| 4,607,678 | 8/1986 | Pomaville et al. | 160/332 |
| 4,924,628 | 5/1990 | Ruby et al. | 49/404 X |

FOREIGN PATENT DOCUMENTS

| | | | |
|---|---|---|---|
| 2054712 | 2/1981 | United Kingdom | 160/332 |

OTHER PUBLICATIONS

Aleco Company untitlted brochure, 2 pages, dated Nov. 1986.

Associated Bag Co. untitled brochure, 3 pages, revised Mar. 19, 1984.

*Primary Examiner*—Blair M. Johnson

*Attorney, Agent, or Firm*—Klarquist, Sparkman, Campbell, Leigh & Whinston

[57] ABSTRACT

A door suspension system has a frame mounting element and a cover element. These elements have projecting clamping elements which cooperate to clamp door strips between them to suspend the strips in a door opening. In addition, one of the cover or frame mounting elements includes a mechanism for supporting pins or other supports from which apertured door strips may be hung. Also, the cover and frame mounting elements may define channels from which door suspension strips may be hung. The combined clamping action and pin support or hanging support of the door strips results in securely supported strips. The cover element and frame mounting element cooperatively engage one another for mounting purposes. In a specifically illustrated embodiment, a set of flanges is provided on the mounting element for mating with a corresponding set of flanges on the cover element for purposes of aligning these elements as they are coupled together.

22 Claims, 3 Drawing Sheets

STRIP DOOR SUSPENSION SYSTEM

BACKGROUND OF THE INVENTION

The present invention relates to a strip door suspension system by which elongated flexible strips are suspended in an opening to form a strip door.

Many prior art strip door suspension systems are known to exist. In these systems, adjacent strips typically overlap one another along their side edges to provide a more effective seal of the door opening. At the same time, the strips may be separated if necessary to permit access through the opening. In one typical example, strip door suspension systems are used to close the openings of cold storage display cases in retail grocery stores. Shoppers can separate the strips to gain access to goods in the display case to which the strip door is mounted. These types of door suspension systems are also frequently used to close other types of door openings, such as in warehouse or storage areas. Vehicles can easily be driven through the openings with the strips forming the strip door being raised by the vehicle as it passes. Of course, strip doors are used in many other applications.

It is highly desirable for the strips to be suspended in a secure manner to prevent them from falling or being pulled down during use. In addition, it is also highly desirable to provide a strip door suspension system which permits the convenient replacement of door strips in the event they become warn or damaged. Furthermore, it is also desirable to provide a strip door suspension system that is easy to install and which is attractive when installed, particularly when the suspension system is to be used in the view of customers in a retail sales establishment. Moreover, it is desirable to provide a versatile strip door suspension system which can accommodate door strips of various types. Despite the existence of prior art strip door suspension systems, a need remains for an improved system which has these and other attributes, individually and collectively.

SUMMARY OF THE INVENTION

In accordance with the present invention, a strip door suspension system is provided for suspending plural strips forming a strip door in a door frame. The system includes an elongated frame mounting element with a base or mounting portion for mounting to an upper section of a door frame which surrounds the door opening. The mounting element has a first elongated clamping element which projects outwardly from the base and away from the door frame. A cover element is coupled to the door frame and has an elongated body with a second elongated clamping element projecting outwardly from the body. When the mounting and cover elements are in position, the first and second clamping elements extend toward one another and are separated by a gap. The mounting and cover elements are movable toward one another to close the gap to thereby clamp strips forming the strip door between the clamping elements. The use of projecting clamping elements of this type facilitates the secure and positive clamping of the door strips in position.

In accordance with another aspect of the invention, the first and second clamping elements may define elongated upwardly opening respective first and second channels. The door strips may be provided with hooks or other suspension mechanisms for engaging the respective first and second channels to hang the door strips in position. By both hanging and clamping the door strips, the strips are securely held in position. In addition, in the event a strip is snagged or pulled, such as by a vehicle passing through a doorway, the dual support provided by the strip suspension mechanism and clamping elements minimizes the possible separation of the door strips from the suspension system.

As still another aspect of the present invention, one of the door mounting elements and cover elements, and typically the door mounting element, supports strip hanging projections which extend outwardly over the clamping elements and above the gap. These strip hanging projections, which may comprise pins, may be used in suspending strips of the type having apertures for receiving the pins. The combination of pin supports and the clamping action by the first and second clamping elements again provides a dual support mechanism for the door strips. As a more specific feature of this aspect of the invention, an elongated slot may be provided for receiving the pins or other projecting strip door supports.

As a further aspect of the present invention, the cover element may be mounted to the mounting element with a mounting mechanism being provided for this purpose. In accordance with the invention, one specific mounting mechanism includes a first set of first and second spaced apart elongated flanges projecting outwardly from the base of the mounting element at a location above the first clamping element. In addition, the cover element includes a second set of first and second spaced apart elongated flanges projecting outwardly from the body above the second clamping element. The first and second sets of flanges are positioned and sized for mating together to couple the cover element to the mounting element. As a result, the cover element is coupled to the door opening frame. In addition, the sets of flanges also serve to align and position the cover element relative to the mounting element. In accomplishing this mating action, the first set of flanges may be inserted between the second set of flanges or vice versa. Typically, one of the sets of flanges, and preferably the set associated with the mounting element, is provided with threads for receiving a threaded fastener inserted through the cover element. With this construction, the fasteners secure the cover element to the mounting element. Of course, other mounting approaches may also be used, such as snap-fit connections and the like.

The present invention is directed not only to the door suspension system as a whole, but also to the unique aspects of the individual components making up the door suspension system.

It is accordingly one object of the present invention to provide an improved door suspension system and components for such a system.

A further aspect of the present invention is to provide a door suspension system which is cost effective to manufacture and install.

Another aspect of the present invention is to provide a door suspension system which is attractive when installed and which is durable.

Still another object of the present invention is to provide a door suspension system which securely mounts door strips in place.

A still further object of the present invention is to provide a door suspension system in which door strips are relatively easy to replace in the event they become worn or damaged.

These and other objects, features and advantages of the present invention will become apparent with reference to the following description and drawings.

DETAILED DESCRIPTION OF A PREFERRED EMBODIMENT

With reference to FIGS. 1-4, a door suspension system in accordance with the present invention is illustrated for suspending plural flexible strips 12 in a door opening 14. The door opening 14 is bounded by a door frame 16 having an upper door frame header or top piece 18 extending across an upper section of the door opening. For convenience, in this description the invention is referred to as a door suspension system for suspending door strips in a door opening. The invention is not limited by this terminology as the term door opening is broadly defined to include any opening whether it be characterized as a "door", a "window" or other type of opening. That is, for purposes of this description, openings of all types are included in the definition of a door opening.

Figure 1:
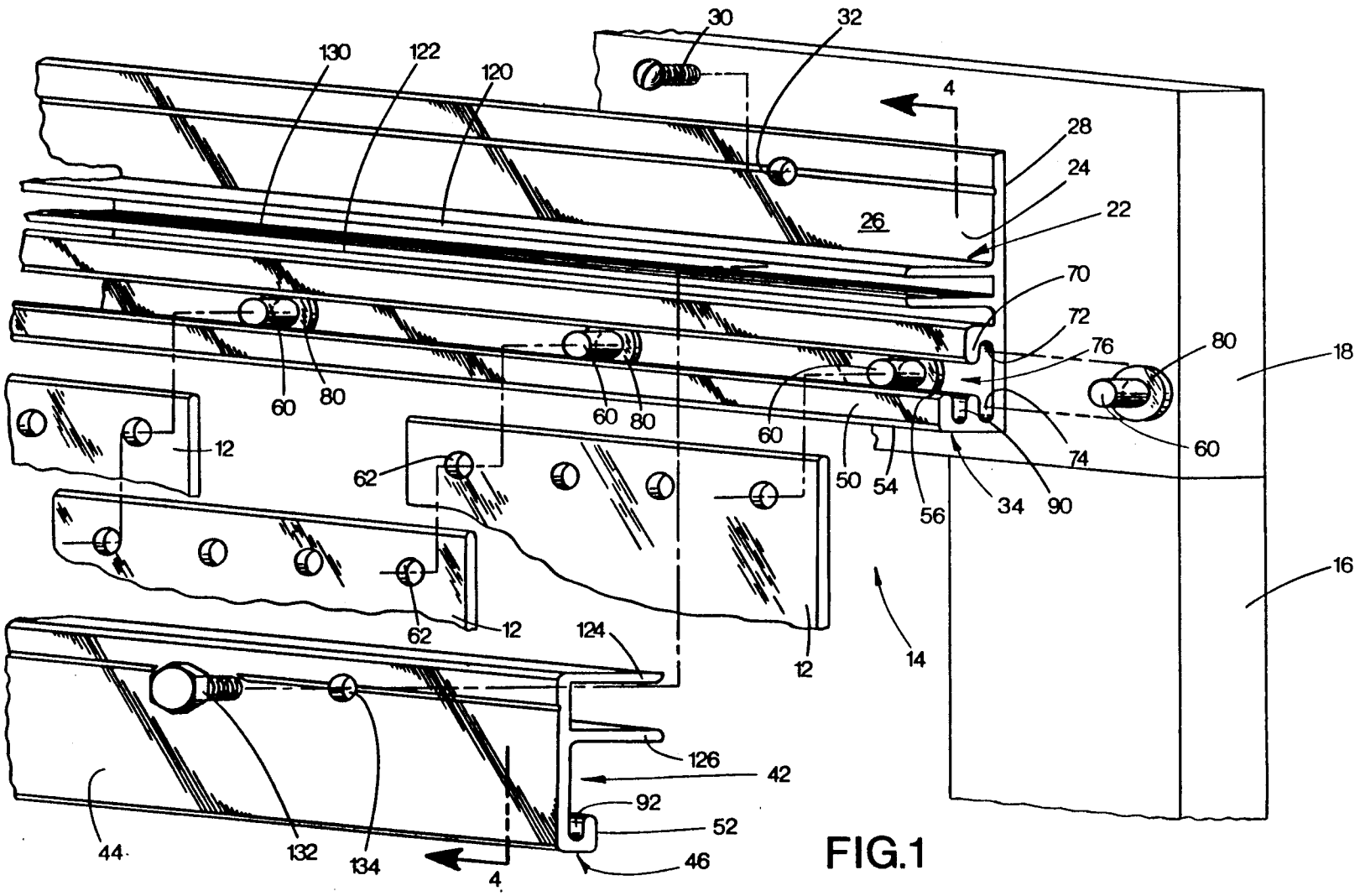
FIG. 1 is an exploded perspective view of a door suspension system in accordance with the present invention showing the suspension of apertured door strips.
Figure 2:
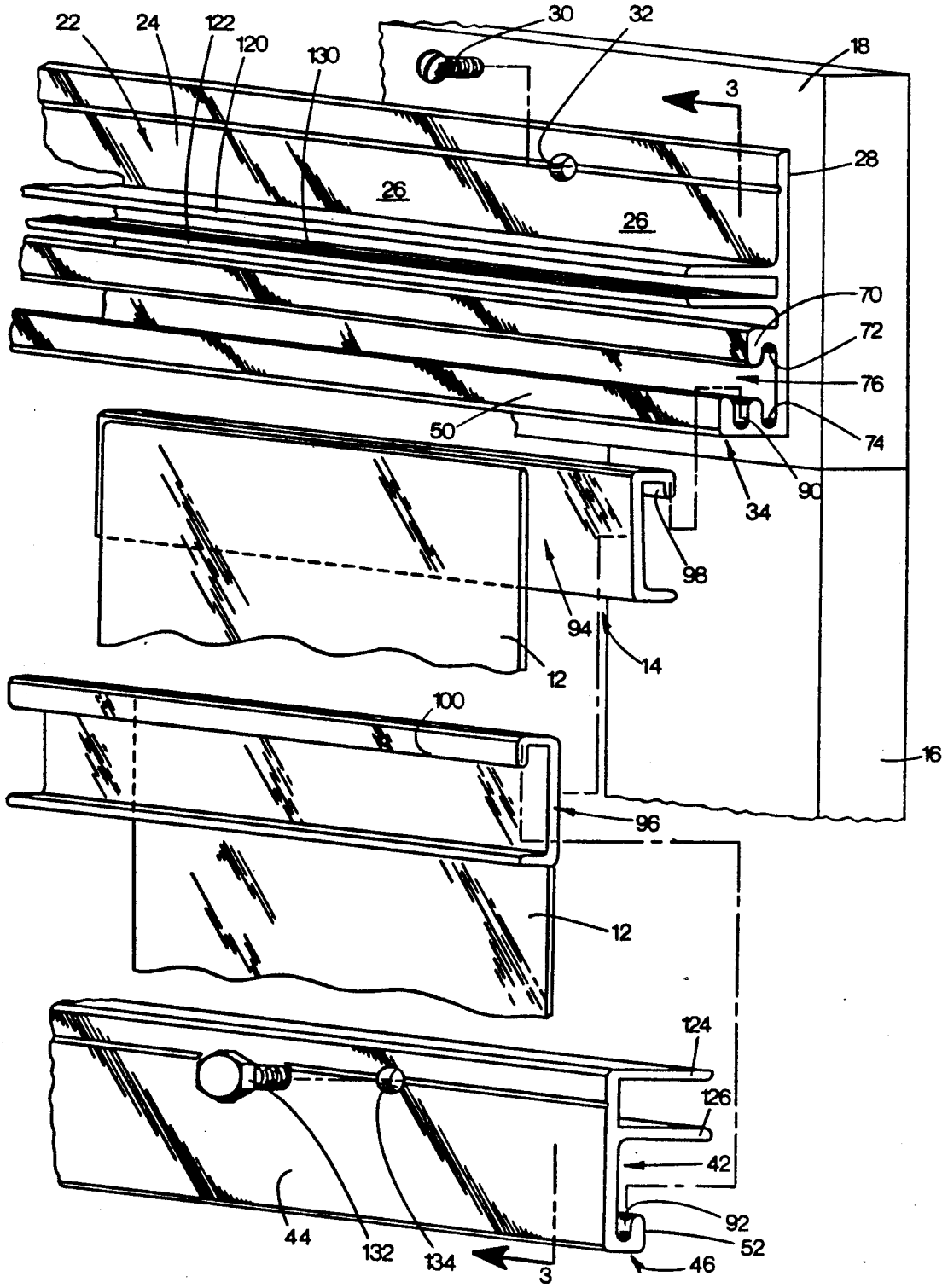
FIG. 2 is an exploded perspective view of a door suspension system in accordance with the present invention showing the suspension of door strips of the type having sup as hooks.

Referring to FIG. 1, the strip door suspension system includes an elongated frame mounting element 22 having an elongated base 24 for mounting to the door frame section 18. The base 24 may take many different forms, but in a preferred form the base has a front surface 26 and a flat, planar back surface 28 for mounting against the corresponding exposed surface of the frame section 18. Fasteners such as screws 30 passing through openings 32 in the base 24 may be used to mount the base in position. Of course, adhesive snap connectors, Velcro, and other mounting mechanisms may also be used.

The frame mounting element 22 has a first elongated clamping element 34 projecting outwardly from the base and away from the door frame section 18. Clamping element 34 typically extends coextensively with the full length of the base 24 and projects in a direction which is generally orthogonal to the base.

The door suspension system includes a cover element 42 with an elongated body 44 and a second elongated clamping element 46. The clamping element 46 also preferably extends coextensively along the length of the body 44 and is oriented to project in a direction which is generally orthogonal to the body. The cover element 42 is coupled to the door frame section 18. Typically, the cover element 42 is mounted to the mounting element 22 to thereby couple the cover element 42 to the door frame section 18. As shown by the arrows in Figure 4, the strip door suspension system components 22, 42 are movable relative to one another. In particular, the cover element 42 may be shifted toward the mounting element 22 to close the gap 48 between the clamping elements 34, 46. As the gap is closed, the clamping elements clamp strips 12 positioned between the clamping elements to hold the strips in position.

For effective clamping purposes, the clamping elements 34, 46 are provided with respective clamping surfaces 50, 52 which are oriented in a face-to-face relationship as the clamping elements are drawn together. Each of the clamping surfaces 50, 52 extends in a generally horizontal direction along the length of the respective clamping elements 34, 46, (assuming the door suspension system components are mounted to a horizontally extending door frame component 18). The illustrated clamping surfaces 50, 52 are generally planar with a sufficient width, for example, approximately about a $\frac{1}{4}''$ or more, to bear against a corresponding portion of the strips 12. A clamping surface of this type, especially when bounded by rounded edges 54, 56, shown adjacent to surface 50 in FIG. 1, minimizes the presence of sharp edges that may tend to cause crimping or tearing of the door strips 12 over time as they are moved during use.

As is also shown in FIG. 1, one of the frame mounted and cover elements 22, 42 includes a support for supporting strip hanging projections which extend outwardly over the clamping elements at a location above the gap between the clamping elements. In the specifically illustrated form, the support is included in the frame mounting element 22 with the projections comprising pins 60 (FIG. 1, FIG. 4) projecting outwardly from the base 28 and above the gap 48. Pin 60 is inserted through apertures in the strips 12, some of these apertures being numbered as 62, such that the strips 12 hang from the supports or pins. With this construction, a dual supporting mechanism is provided for the strips. That is, the strips are supported by the pins and also are clamped between the respective clamping elements 34, 46. As a result, the weight of the strips is supported by the pins, and partially by the clamping elements, with sliding of the strips along the door opening being prevented by the clamping elements and to a lesser extent by the engagement of the pins 60 to the frame mounting element 22 as explained below. Moreover, as can be seen from FIG. 4, it is extremely easy and convenient to position the strips on the pins and then simply clamp the door suspension elements 22, 42 together. By reversing this process, door strips can readily be replaced in the event they become worn or damaged.

With further reference to FIG. 1, the mounting element 22 includes a flange 70 projecting outwardly from the surface 26 of base 24 at a location above the clamping element 34. The flange 70 defines a downwardly opening elongated channel section 72. Similarly, the clamping element 34 defines an upwardly opening channel section 74 beneath the channel section 72. The two channel sections 72, 74 cooperate to define a slotway 76 having a slot opening 78 (FIG. 4) through which the pins 60 extend.

The pins 60 have a base 80 sized for insertion into the slotway 76 as shown in FIG. 1. The channel sections 72, 74 of the clamping element 34 and flange 70 retain the pin bases 80, within the slotway 76. Yet, the pin bases 80 and thereby the pins, may be slid along the length of the slotway to the desired positions for engaging the apertures 62 of the door strips 12. Instead of pins mounted to respective individual bases 80, a common base may be used with the respective pins projecting from this common base and the common base being inserted into the slotway 76.

Figure 3:
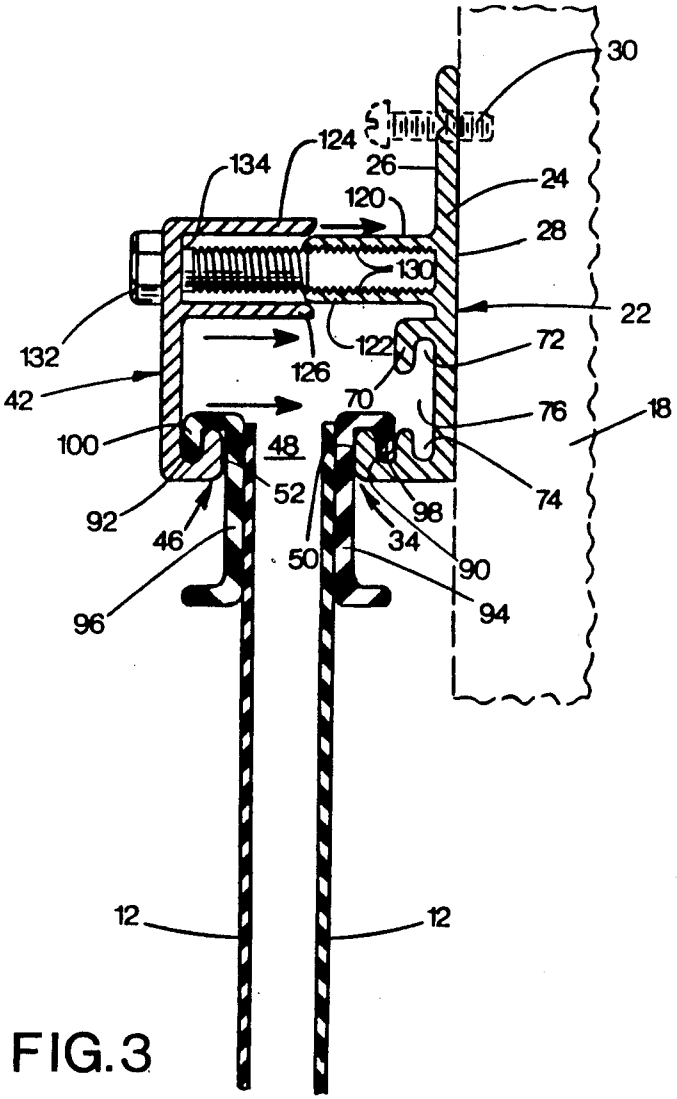
FIG. 3 is a vertical sectional view of the door suspension system FIG. 2, taken along line 3—3 thereof.

As also shown in FIG. 1, th clamping element 34 may define a channel 90, which may be upwardly opening as shown in FIG. 1, with the clamping element 46 defining a similar channel 92. The door strips 12 may, in a conventional manner, be provided with support elements 94, 96 (FIG. 2) secured to their upper ends. These support elements may comprise extruded plastic components adhesively, heat bonded, or otherwise secured to the strips. The support element 94 includes a downturned hook portion 98 for insertion into and support by the channel 90. Similarly, the support element 96 may include a downturned hook portion 100 for insertion into the channel 92. In this manner, the strips 12 may be hung from the mounting and cover elements of the door suspension system. In addition, as shown in FIG. 3, as the cover element 42 is drawn toward the frame mounting element 22, the associated clamping elements 46, 34 are drawn together to close the gap 48. Eventually the clamping elements 34, 46 are drawn together to the extent that the door strips 12, and their accompanying supports 94, 96, are clamped by the clamping elements in position. As a result, a dual suspension approach is also provided in this configuration as the door strips are suspended by the hooks 98, 100 and also clamped by the clamping elements 34, 46. As is apparent from FIG. 3, it is convenient and easy to position the door strips in place and to remove these door strips in the event they become worn or damaged.

It should be noted that the door suspension system of the present invention is extremely versatile as it will accommodate strips of the type having apertures as well as strips of the type having suspension hooks. In addition, a dual strip support mechanism is provided with this construction. Thus, the strips may be supported by a combination of the clamping by the clamping elements 34, 46 and by the strip supporting projections, such as pins 60, or by suspension elements, such as hooks 98, 100. Although the versatility would suffer, one can eliminate the channels 90, 92 while retaining the slotway 76 and still provide a dual support by the pins 60 and the clamping elements. Similarly, one could retain the channels 90, 92 and eliminate the slotway 76. In this latter example, a dual support would be provided by the hooks 98, 100 and by the clamping elements.

Figure 4:
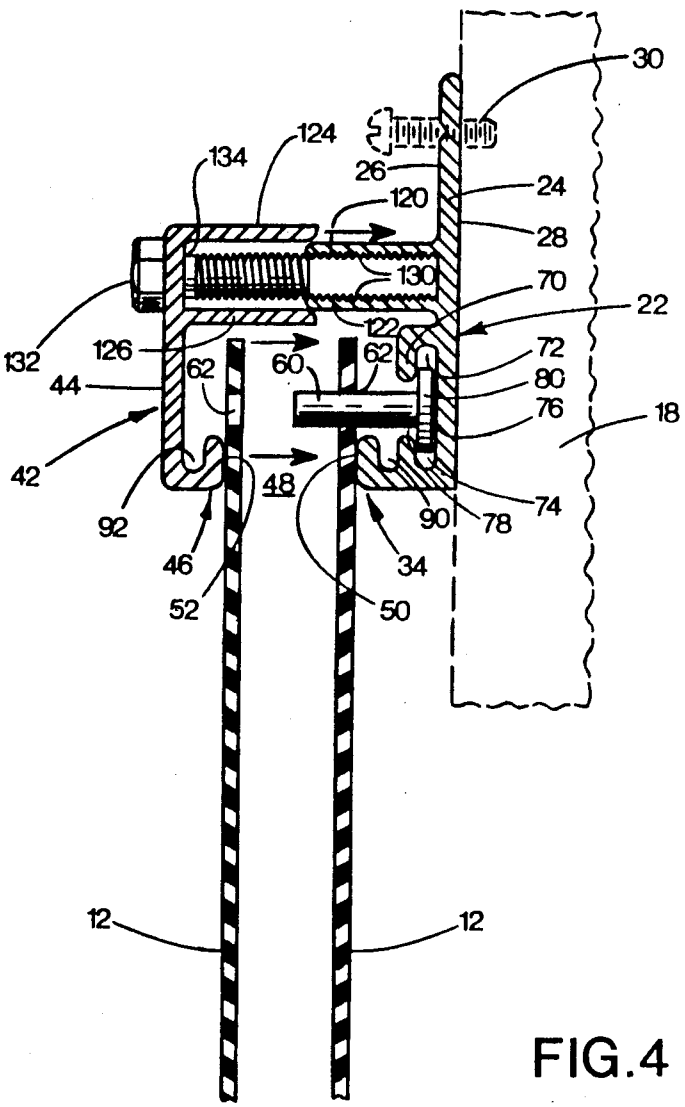
FIG. 4 is a vertical sectional view of the door suspension system of FIG. 1, taken along line 4—4 thereof.

Referring again to FIG. 1, although the cover element 42 may be directly mounted to the door frame section 18, the preferred approach is to mount the cover element to the frame mounting element 22 to thereby couple the cover element to the frame. For mounting purposes, the cover element 42 and mounting element 22 are provided with a cooperatively engaging coupling mechanism for interconnecting these elements. In the illustrated form of this mechanism, a first set of spaced apart, parallel projecting flanges 120, 122 are positioned above the clamping element 34 and above the flange 70. The flanges 120, 122 project outwardly from the exposed surface 26 of base 28 in a direction generally orthogonal to the base. Similarly, a second set of spaced apart, parallel flanges 124, 126 project outwardly from the base 44 of cover element 42 in a direction generally orthogonal to base 44. The flanges 124, 126 are positioned above the clamping element 46. As shown in FIGS. 3 and 4, the respective sets of flanges 120, 122 and 124, 126 mate with one another to interconnect and align the frame mounting element 22 and cover element 42. In particular, the set of flanges 120, 122 are telescopingly received between the set of flanges 124, 126. In addition, the adjacent surfaces of flanges 120, 122 may be provided with threads 130. In this case, threaded fasteners 132 may be inserted through openings 134 (Figure 1) of the base 44 of cover element 42 and threaded into the threads 130 to thereby interconnect the door suspension system components 22, 42. By tightening fasteners 132, the components 22, 42 are drawn together.

The resulting door suspension system is attractive in that cover element 42 in general hides the upper ends of the door strips. In addition, the door suspension mechanism is substantially sealed above the strips by the interconnected sets of flanges and at the bottom by the action of the clamping elements. Consequently, the possibility of dust and dirt accumulating in the channels and slotway of the mechanism is reduced. End caps, not shown, may also be used to seal the ends of the suspension system.

Although the frame mounting element 22 and cover element 42 may be of any suitable material and construction, they may be formed, for example, by extrusion. As a specific example, a plastic material, such a polyvinyl chloride, or metal, such as aluminum, may be extruded to form those door suspension system components.

Having illustrated and described the principles of my invention with reference to a preferred embodiment, it should be apparent to those of ordinary skill in the art that my invention may be modified in arrangement and detail without departing from such principles. I claim all such modifications which fall within the scope and spirit of the following claims.

I claim:

1. A strip door suspension system for suspending plural strips forming a strip door in a door frame, the system comprising:

an elongated frame mounting element having a base for mounting to an upper section of a door frame and a first elongated clamping element projecting outwardly from the base and away from the door frame and terminating in a first flange which defines a first clamping surface; and a cover element having an elongated body and a second elongated clamping element projecting outwardly from the body and terminating in a second clamping surface, the cover element being coupled to the door frame with the second clamping element extending toward the first clamping element with the first and second clamping surfaces being oriented in a face-to-face relationship when the frame mounting element and the cover element are drawn together, with the first and second clamping elements being separated by a gap between the first and second clamping surfaces and such that the first and second clamping elements are movable toward one another to close the gap to thereby clamp strips forming the strip door between the clamping elements.

2. A strip door suspension system for suspending plural strips forming a strip door in a door frame, the system comprising:

an elongated frame mounting element having a base for mounting to an upper section of a door frame and a first elongated clamping element projecting outwardly from the base and away from the door frame; and a cover element having an elongated body and a second elongated clamping element projecting outwardly from the body, the cover element being coupled to the door frame with the second clamping elements extending toward the first clamping element and separated by a gap and such that the first and second clamping elements are movable toward one another to close the gap to thereby clamp strips forming the strip door between the clamping elements;

wherein the first clamping element defines an elongated upwardly opening first channel and the second clamping element defines an elongated upwardly opening second channel, whereby strips may be hung from the respective first and second channels and clamped between the first and second clamping elements.

3. A strip door suspension system for suspending plural strips forming a strip door in a door frame, the system comprising:

an elongated frame mounting element having a base for mounting to an upper section of a door frame and a first elongated clamping element projecting outwardly from the base and away from the door frame; and a cover element having an elongated body and a second elongated clamping element projecting outwardly from the body, the cover element being coupled to the door frame with the second clamping elements extending toward the first clamping element and separated by a gap and such that he first and second clamping elements are movable toward one another to close the gap to thereby clamp strips forming the strip door between the clamping elements;

wherein one of the elongated frame mounting element and the cover element includes a support for supporting strip hanging projections which extend outwardly over the clamping elements and above the gap, whereby strips of the type having apertures may be supported from the projections and clamping between the first and second clamping elements.

4. A strip door suspension system according to claim 3 in which the support comprises an elongated slotway having upper and lower elongated channel sections and a slot opening through which the strip hanging projections extend.

5. A strip door suspension system according to claim 2 in which one of the frame mounting element and the cover element defines support means for supporting strip hanging projections which extend outwardly over the clamping elements and above the gap, whereby strips of the type having apertures may be supported from the projections and clamped between the first and second clamping elements.

6. A strip door suspension system according to claim 5 in which the support means comprises an elongated slotway on the frame mounting element, the slotway having an upper channel section and a lower channel section and a slot opening through which the strip hanging projections extend, the lower channel section being spaced from the gap by the first clamping element.

7. A strip door suspension system according to claim 6 in which the first and second clamping elements each include an upwardly opening channel section from which strips may be hung as well as clamped by the clamping sections.

8. A strip door suspension system for suspending plural strips forming a strip door in a door frame, the system comprising:

an elongated frame mounting element having a base for mounting to an upper section of a door frame and a first elongated clamping element projecting outwardly from the base and away from the door frame; and a cover element having an elongated body and a second elongated clamping element projecting outwardly from the body, the cover element being coupled to the door frame with the second clamping elements extending toward the first clamping element and separated by a gap and such that the first and second clamping elements are movable toward one another to close the gap to thereby clamp strips forming the strip door between the clamping elements;

wherein the frame mounting element includes a first set of first and second spaced apart elongated flanges projecting outwardly from the base at a location above the first clamping element and the cover element includes a second set of first and second spaced apart elongated flanges projecting outwardly from the body above the second clamping element, the first and second sets of flanges mating together to couple the cover element to the frame mounting element and thereby to the frame.

9. A strip door suspension system according to claim 3 in which the frame mounting element includes a first set of first and second spaced apart elongated flanges projecting outwardly from the base at a location above the first clamping element and the covering element includes a second set of first and second spaced apart elongated flanges projecting outwardly from the body above the second clamping element, the first and second sets of flanges mating together to couple the cover element to the frame mounting element and thereby to the frame.

10. A strip door suspension system according to claim 5 in which the frame mounting element includes a first set of first and second spaced apart elongated flanges projecting outwardly from the base at a location above the first clamping element and the covering element includes a second set of first and second spaced apart elongated flanges projecting outwardly from the body at a location above the second clamping element, the first and second sets of flanges mating together to couple the covering element to the frame mounted element and thereby to the frame.

11. A strip door suspension system for suspending plural strips each having a pin receiving hole therethrough, the plural strips forming a strip door in a door frame, the suspension system comprising:

a unitary mounting element having a base and a first clamp element, the mounting element being adapted for attachment to the door frame, the first clamp element protruding outwardly from the base and having a first elongated clamping surface spaced from the base;

a second clamp element coupled to the mounting element;

the second clamp element having a body and a clamping projection which extends outwardly from the body, the clamping projection having a second clamping surface which is positioned in a face-to-face relation with the first clamping surface when the first and second clamp elements are drawn together, whereby each strip is clamped between the first and second clamping surfaces as the clamping elements are drawn together;

clamp means for drawing the first and second clamp elements together;

a plurality of pin elements each having a post portion which has distal and proximal ends and defines a longitudinal pin axis, the pin elements having a base portion which is attached to a proximal end of the post portion, the post portion being sized for insertion through a strip pin receiving hole; and wherein one of the mounting element and the second clamp element includes transverse channel means for slidably receiving and retaining the base portion of each pin element with each longitudinal pin axis in a substantially horizontal plane, whereby movement of each pin element is restricted by the channel means to a path transverse to each longitudinal pin axis for adjustment during assembly of the suspension system.

12. A strip door suspension system according to claim 11 wherein the transverse channel means is located above the first and second clamping surfaces when such surfaces are drawn together by the clamp means.

13. A strip door suspension system for suspending plural strips forming a strip door in a door frame for use with strips each having an upper edge with a downwardly extending hook projecting therefrom, the suspension system comprising:

a mounting element having a base and a first clamp element, the mounting element being adapted for attachment to the door frame, the first clamp element protruding upwardly from the base and having a first elongated clamping surface spaced from the base;

a second clamp element coupled to the mounting element;

the second clamp element having a body and a clamping projection which extends outwardly from the body, the clamping projection having a second clamping surface which is positioned in a face-to-face relation with the first clamping surface when the first and second clamp elements are drawn together, whereby each strip is clamped between the first and second clamping surfaces as the clamp elements are drawn together; and clamp means for drawing the first and second clamp elements together;

wherein each of the clamp elements includes an upwardly opening channel for receiving hook projections of the strips to support the strips, the upwardly opening channels being located above the first and second clamping surfaces when drawn together by the clamp means such that the supported strips may also be clamped by the clamping surfaces.

14. A strip door suspension system for suspending plural strips forming a strip door in a door frame, the suspension system comprising:

a unitary mounting element having a base and a first clamp element, the mounting element being adapted for attachment to the door frame, the first clamp element protruding outwardly from the base and having a first elongated clamping surface spaced from the base;

a second clamp element coupled to the mounting element;

the second clap element having a body and a clamping projection which extends outwardly from the body, the clamping projection having a second clamping surface which is positioned in a face-to-face relation with the first clamping surface when the first and second clamp elements are drawn together, whereby each strip is clamped between the first and second clamping surfaces as the clamping elements are drawn together; and clamp means for drawing the first and second clamp elements together, with one of the mounting element and the second clamp element having an externally threaded member projecting outwardly therefrom toward the other of the mounting element and the second clamp element, and with the other of the mounting element and the second clap element including transverse internally threaded receptacle means projecting outwardly therefrom for threadably receiving the externally threaded member, whereby the clamping surfaces may be drawn together by threading the threaded member into the threaded receptacle means.

15. A strip door suspension system for suspending plural strips forming a strip door in a door frame, the suspension system comprising:

a mounting element having a base and a first clamp element, the mounting element being adapted for attachment to the door frame, the first clamp element protruding upwardly from the base and having a first elongated clamping surface spaced from the base;

a second clamp element coupled to the mounting element;

the second clamp element having a body and a clamping projection which extends outwardly from the body, the clamping projection having a second clamping surface which is positioned in a face-to-face relation with the first clamping surface when the first and second clamp elements are drawn together, whereby each strip is clamped between the first and second clamping surfaces as the clamping elements are drawn together; and clamp means for drawing the first and second clamp elements together, the clamp means including one of the mounting element and the second clamp element having an externally threaded member projecting outwardly therefrom toward the other of the mounting element and the second clamp element, and the other of the mounting element and the second clamp element having transverse internally threaded receptacle means projecting outwardly therefrom for threadably receiving the externally threaded member, whereby the clamping surfaces may be drawn together by threading the threaded member into the threaded receptacle means;

wherein the threaded receptacle means comprises threaded channel means with external upper and lower surfaces; and wherein the one of the mounting element and the second clamp element having the externally threaded member includes alignment means for engaging the threaded channel means external upper and lower surfaces to align the first and second clamping surfaces in the face-to-face relation and to interlock the mounting element and the second clamp element.

16. A strip door assembly for suspension from a door frame, comprising:

strip means for forming a strip door comprising plural strips of a flexible material, each strip having an upper edge with strip suspension means located along the upper edge for suspending the strip in a downwardly hanging orientation; and first and second clamping means for clamping and retaining therebetween the strip means, wherein:

(a) one of the first and second clamping means has means for receiving attachment means for attaching the assembly to the door frame;

(b) one of the first and second clamping means has first strip engaging means for engaging and suspending the strip suspension means; and (c) one of the first and second clamping means has a first clamp element protruding in a direction toward the other of the first and second clamping means, the first clamp element having a first clamping surface, the other of the first and second clamping means surfaces facing together when the assembly is attached to the door frame to clamp and retain the strip means therebetween;

wherein the strip suspension means comprises a downwardly extending hook; and wherein the first strip engaging means comprises a first trough having a first exterior wall formed by the fist clamp element, with an outer surface of the first exterior wall serving as the first clamping surface, the first trough and first exterior wall being sized to engage the downwardly extending hook.

17. A strip door assembly according to claim 16 wherein:

the plural strips of the strip door comprise a first and a second group of strips;

the first strip engaging means engages and suspends the first group of strips; and the other of the first and second clamping means has second strip engaging means for engaging and suspending the second group of strips, with the second strip engaging means comprising a second trough having a second exterior wall with an outer surface serving as the second clamping surface, the second trough and second exterior wall being sized to engage the downwardly extending hook.

18. A strip door assembly for suspension from a door frame, comprising:

strip means for forming a strip door comprising plural strips of a flexible material, each strip having an upper edge with a width and with strip suspension means located along the upper edge for suspending the strip in a downwardly hanging orientation; and first and second clamping means for clamping and retaining therebetween the strip means, wherein:

(a) one of the first and second clamping means has means for receiving attachment means for attaching the assembly to the door frame;

(b) one of the first and second clamping means has first strip engaging means for engaging and suspending the strip suspension means; and (c) one of the first and second clamping means has a first clamp element protruding in a direction toward the other of the first and second clamping means, the first clamp element having a first clamping surface, the other of the first and second clamping means having a second clamping surface longer than plural strip widths, the first and second clamping surfaces facing together when the assembly is attached to the door frame to clamp and retain the strip means therebetween;

the strip suspension means comprises a pin receiving hole through the strips located near the upper edge of the strip;

the first strip engaging means comprises:

(a) a plurality of pin elements each having a post portion which defines a longitudinal pin axis and a has portion which is attached to a proximal end of the post portion, the post portion being sized for receipt by the pin receiving hole of a strip; and (b) transverse channel means for slidably receiving and retaining the base portion of each pin element with each longitudinal pin axis in a substantially horizontal plane, whereby movement of each pin element is restricted by the channel means to a path transverse to each longitudinal pin axis for adjustment during installation of the assembly; and the pin base portion being separate from the first and second clamping surfaces.

19. A strip door assembly for suspension from a door frame, comprising:

strip means for forming a strip door comprising plural strips of a flexible material, each strip having an upper edge with a width and with strip suspension means located along the upper edge for suspending the strip in a downwardly hanging orientation; and first and second clamping means for clamping and retaining therebetween the strip means, wherein:

(a) one of the first and second clamping means has means for receiving attachment means for attaching the assembly to the door frame;

(b) one of the first and second means has first strip engaging means for engaging and suspending the strip suspension means; and (c) one of the first and second clamping means has a first clamp element protruding in a direction toward the other of the first and second clamping means, the first clamp element having a first clamping surface, the other of the first and second clamping means having a second clamping surface longer than plural strip widths, the first and second clamping surfaces facing together when the assembly is attached to the door frame to clamp and retain the strip means therebetween; and wherein one of the first and second clamping means has projecting therefrom externally threaded means for clamping together the first and second clamping means; and the other of first and second clamping means has projecting therefrom an internally threaded channel means for threadably receiving the externally threaded means to clamp together the first and second clamping means.

20. A strip door assembly for suspension from a door frame, comprising:

strip means for forming a strip door comprising plural strips of a flexible material, each strip having an upper edge with strip suspension means located along the upper edge for suspending the strip in a downwardly hanging orientation;

first and second clamping means for clamping and retaining therebetween the strip means, wherein:

(a) one of the first and second clamping means has means for receiving attachment means for attaching the assembly to the door frame;

(b) one of the first and second clamping means has first strip engaging means for engaging and suspending the strip suspension means; and (c) one of the first and second clamping means has a first clamp element protruding in a direction toward the other of the first and second clamping means, the first clamp element having a first clamp surface, the other of the first and second clamping means having a second clamping surface, the first and second clamping surfaces facing together when the assembly is attached to the door frame to clamp and retain the strip means therebetween;

wherein one of the first and second clamping means has projecting therefrom externally threaded means for clamping together the first and second clamping means;

wherein the other of first and second clamping means has projecting therefrom an internally threaded channel means for threadably receiving the externally threaded means to clamp together the first and second clamping means;

wherein the threaded channel means has external upper and lower surfaces; and wherein the one of the first and second clamping means having the externally threaded member includes means for engaging the threaded channel means external upper and lower surfaces to align and interlock the first and second clamping means.

21. A strip door suspension system for suspending plural strips forming a strip door in a door frame, each strip having an upper edge with a downwardly extending hook projecting therefrom, the suspension system comprising: p1 a mounting element having means for receiving attachment means for attaching the mounting element to the door frame, the mounting element including a first wall with a first clamping surface;

a clamping element having a first wall with a first clamping surface;

one of either the mounting element and the clamping element further including a second wall substantially parallel to the first wall and in a plane parallel to a plane containing the first wall and a third wall substantially normal to and interconnecting the first and second walls, the first clamping surface facing away from the second wall, with the first, second and third walls forming a first upwardly extending hook for engaging the downwardly extending hook of each strip; and clamp means for clamping the first clamping surfaces of the mounting and clamping elements together to capture each strip between the first clamping surfaces when hooked on the first upwardly extending hook.

22. A strip door suspension system for suspending plural strips forming a strip door in a door frame, each strip having an upper edge with a downwardly extending hook projecting therefrom, the suspension system comprising:

a mounting element having means for receiving attachment means for attaching the mounting element to the door frame, the mounting element including a first wall with a first clamping surface;

a clamping element having a first wall with a first clamping surface;

one of either the mounting element and the clamping element further including a second wall substantially parallel to the first wall and a third wall substantially normal to and interconnecting the first and second walls, the first clamping surface facing away from the second wall, with the first, second and third walls forming a first upwardly extending hook for engaging the downwardly extending hook of each strip; and clamp means for clamping the fist clamping surfaces of the mounting and clamping elements together to capture each strip between the first clamping surfaces when hooked on the first upwardly extending hook; and the plural strips of the strip door comprise a first and a second group of strips;

the other of the mounting element and the clamping element also includes a second wall substantially parallel to the first wall and as third wall substantially normal to and interconnecting the first and second walls, the first clamping surface facing away from the second wall, with the first, second and third walls forming a second upwardly extending hook; and the downwardly extending hooks of each strip within the first group of strips engaging the first upwardly extending hook, and the downwardly extending hooks of each strip within the second group of strips engaging the second upwardly extending hook, whereby the strips within the first group may be spaced apart and partially overlap the strips within the second group.

* * * * *

UNITED STATES PATENT AND TRADEMARK OFFICE

CERTIFICATE OF CORRECTION

PATENT NO. : 5,146,971

DATED : September 15, 1992

INVENTOR(S) : Lon H. McCarty

It is certified that error appears in the above-indentified patent and that said Letters Patent is hereby corrected as shown below:

Column 3, line 13, "sup" should be --supports such--;

Column 5, line 1, "th" should be --the--;

Column 10, line 1, claim 14, "clap" should be --clamp--;

Column 10, line 16, claim 14, "clap" should be --clamp--;

Column 12, line 10, claim 18, "has" should be --base--;

Column 12, line 35, claim 19, "second means" should be --second clamping means--;

UNITED STATES PATENT AND TRADEMARK OFFICE

CERTIFICATE OF CORRECTION

PATENT NO. : 5,146,971

DATED : September 15, 1992

INVENTOR(S) : Lon H. McCarty

It is certified that error appears in the above-indentified patent and that said Letters Patent is hereby corrected as shown below:

Column 13, line 7, claim 20, "clamp" should be --clamping--; second occurrence and Column 13, line 34, claim 21, "p1" should be deleted, and a new paragraph should begin with the words --a mounting element--.

Signed and Sealed this

Twenty-third Day of November, 1993

*Attest:*

Bruce Lehman

BRUCE LEHMAN

*Attesting Officer*

*Commissioner of Patents and Trademarks*